US012551817B2

(12) United States Patent
Kelly et al.

(10) Patent No.: US 12,551,817 B2
(45) Date of Patent: Feb. 17, 2026

(54) CHOMPING BUBBLE PRODUCING TOY

(71) Applicant: LIGHTUPTOYS.COM, LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US); Christopher W. Chung, Orlando, FL (US); Renata T. Kelly, New Albany, IN (US)

(73) Assignee: LightUpToys.com LLC, Sellersburg, IN (US)

( * ) Notice: Subject to any disclaimer, the term of this patent is extended or adjusted under 35 U.S.C. 154(b) by 228 days.

(21) Appl. No.: 18/500,444

(22) Filed: Nov. 2, 2023

(65) Prior Publication Data

US 2024/0066424 A1 Feb. 29, 2024

Related U.S. Application Data

(63) Continuation-in-part of application No. 17/335,447, filed on Jun. 1, 2021, now Pat. No. 12,097,447.

(Continued)

(51) Int. Cl.

*A63H 33/28* (2006.01)
*A63H 5/00* (2006.01)

(Continued)

(52) U.S. Cl.

CPC ..... *A63H 33/28* (2013.01); *A63H 5/00* (2013.01); *A63H 33/22* (2013.01); *A63H 3/006* (2013.01); *A63H 3/28* (2013.01)

(58) Field of Classification Search

CPC ..... A63H 33/28

See application file for complete search history.

(56) References Cited

U.S. PATENT DOCUMENTS 3,093,925 A * 6/1963 Greene ..... A63H 33/28 446/29
3,228,136 A * 1/1966 Rouse ..... A63H 33/28 446/16

(Continued)

FOREIGN PATENT DOCUMENTS

CN 208176988 U 12/2018

*Primary Examiner* — Eugene L Kim
*Assistant Examiner* — Matthew B Stanczak
(74) *Attorney, Agent, or Firm* — Jessica C. Ronald; Scott R. Cox

(57) ABSTRACT

A chomping bubble producing toy including a shaft secured between a bubble solution reservoir and a housing. The housing is the shape of a character and includes an upper and moveable lower jaw piece. A lever is secured to a connection rod within the housing, which connection rod is secured to the lower jaw about a rotational axle. When the lever is pulled, the connection rod moves upward, which pushes the lower jaw down about the fixed rotational axle. A compression spring is secured to the connection rod, which spring keeps the jaw closed when the lever is at rest. Secured within the housing adjacent to the connection rod is a lever switch. When the lever is pulled, the connection rod moves and contacts the lever switch, thereby triggering it, which automatically plays sound from a speaker within the device and/or transmits a wireless signal.

20 Claims, 22 Drawing Sheets

Related U.S. Application Data

(60) Provisional application No. 63/383,272, filed on Nov. 11, 2022.

(51) Int. Cl.

| | |
|---|---|
| ***A63H 33/22*** | (2006.01) |
| *A63H 3/00* | (2006.01) |
| *A63H 3/28* | (2006.01) |

(56) References Cited

U.S. PATENT DOCUMENTS

| | | | | | |
|---|---|---|---|---|---|
| 4,804,346 | A * | 2/1989 | Sheng | A63H 33/28 | 446/17 |
| 4,957,464 | A * | 9/1990 | Perez | A63H 33/28 | 446/16 |
| 5,035,665 | A | 7/1991 | Sheng | | |
| 5,297,979 | A | 3/1994 | Amron | | |
| 5,605,485 | A * | 2/1997 | Spector | F41B 9/004 | 446/72 |
| 5,609,507 | A * | 3/1997 | Spector | F41B 9/0081 | 446/72 |
| 5,746,636 | A * | 5/1998 | Cernansky | A63H 11/10 | 446/16 |
| 5,842,899 | A * | 12/1998 | Cernansky | A63H 7/04 | 446/16 |
| 6,022,273 | A * | 2/2000 | Gabai | A63H 30/04 | 345/474 |
| 6,024,623 | A | 2/2000 | Menow et al. | | |
| 6,119,286 | A * | 9/2000 | Briscoe | A63H 33/28 | 4/675 |
| 7,056,182 | B2 * | 6/2006 | Wan | A63H 33/28 | 446/15 |
| 7,470,165 | B2 * | 12/2008 | Ivanic | A63H 33/28 | 446/15 |
| 7,914,359 | B2 * | 3/2011 | Thai | A63H 33/28 | 446/15 |
| 8,123,584 | B2 * | 2/2012 | Thai | A63H 33/28 | 446/16 |
| 8,267,736 | B2 * | 9/2012 | Lam | A63H 33/28 | 446/19 |
| 11,826,669 | B2 * | 11/2023 | Lo | A63H 33/28 | |
| 11,918,931 | B2 | 3/2024 | Kelly et al. | | |
| 12,097,447 | B2 * | 9/2024 | Kelly | A63H 33/22 | |
| 2002/0094744 | A1 * | 7/2002 | Cheng | A63H 33/28 | 446/15 |
| 2006/0084351 | A1 * | 4/2006 | Wan | A63H 33/28 | 446/15 |
| 2007/0117491 | A1 * | 5/2007 | Thai | A63H 33/28 | 446/15 |
| 2007/0270073 | A1 * | 11/2007 | Thai | A63H 33/28 | 446/15 |
| 2007/0298674 | A1 * | 12/2007 | Ivanic | A63H 33/28 | 446/15 |
| 2011/0287685 | A1 * | 11/2011 | Lam | A63H 33/28 | 446/15 |
| 2013/0217293 | A1 * | 8/2013 | Burguieres | A63H 33/28 | 446/24 |
| 2014/0364032 | A1 * | 12/2014 | Kelly | A63H 33/28 | 446/15 |
| 2015/0024652 | A1 * | 1/2015 | Lee | A63H 33/28 | 446/15 |
| 2015/0290551 | A1 * | 10/2015 | Davies | A63H 33/26 | 446/15 |
| 2016/0018083 | A1 | 1/2016 | Kelly et al. | | |
| 2019/0111358 | A1 * | 4/2019 | Kelly | A63H 33/28 | |
| 2020/0054959 | A1 * | 2/2020 | Weigl, Jr. | A63H 33/28 | |
| 2021/0379503 | A1 * | 12/2021 | Kelly | A63H 33/22 | |
| 2022/0049842 | A1 | 2/2022 | Kelly et al. | | |
| 2022/0168662 | A1 * | 6/2022 | Kelly | A63J 5/028 | |
| 2022/0379232 | A1 * | 12/2022 | Kelly | A63H 33/28 | |
| 2023/0111031 | A1 | 4/2023 | Kelly et al. | | |
| 2023/0241527 | A1 * | 8/2023 | Petrarca | A63H 33/28 | 446/16 |
| 2023/0277953 | A1 * | 9/2023 | Kelly | A63H 33/22 | 446/15 |
| 2023/0277954 | A1 * | 9/2023 | Kelly | A63H 30/04 | 446/15 |
| 2024/0017163 | A1 * | 1/2024 | Wen | A63H 33/22 | |
| 2024/0058715 | A1 * | 2/2024 | Kelly | A63H 27/10 | |
| 2024/0066424 | A1 * | 2/2024 | Kelly | A63H 33/28 | |
| 2024/0149226 | A1 * | 5/2024 | Kelly | B01F 23/232 | |
| 2025/0001324 | A1 * | 1/2025 | Kelly | A63H 33/28 | |
| 2025/0159772 | A1 * | 5/2025 | Kelly | A63H 33/26 | |

* cited by examiner

CHOMPING BUBBLE PRODUCING TOY

CROSS-REFERENCE TO RELATED APPLICATIONS

This application claims benefit of provisional application No. 63/383,272 filed on Nov. 11, 2022 and is also a continuation-in-part of and claims the benefit of U.S. application Ser. No. 17/335,447 filed on Jun. 1, 2021. The entire contents of the above applications are incorporated herein by reference.

FIELD OF INVENTION

The invention relates to the technical field of a bubble producing toys. More particularly to a chomping bubble producing toy wherein activation of the chomping mechanism triggers a sound.

BACKGROUND OF THE INVENTION

Bubble producing toys and electric bubble producing toys are known. However, many known toys leak from the overproduction of bubbles. Accordingly, the toys become less useful or even nonfunctional as a result of this excess solution leaking onto the electric components of the toys. Moreover, this leakage results in the bubble solution being deposited on the hands of the user, leading to a non-user-friendly toy. This leakage also leads to large quantities of bubble solution being wasted and the need for frequent refilling leading to a shortened lifetime of the toy. Moreover, these toys tend to overheat as there is no fail-safe for when the speed of the motor is too high.

Further, many known toys do not have a structure that catches excess bubble solution and recirculates this solution through the bubble producing toy. If such a structure exists, it is easily broken, which causes excess solution to leak internally.

Further, many known bubble producing toys do not include a chomping mechanism because the movement needed to perform the chomping feature impedes the bubble production of the toy. Or, if these known toys can perform a chomping mechanism and bubble production, both functions are not able to be performed simultaneously. Furthermore, these known toys do not emit bubbles in a way in which they can be chomped. Further, the chomping feature does not trigger a sound. Moreover, these known toys do not project light through the chomping mechanism, thereby illuminating the bubbles in a unique pattern.

SUMMARY OF THE INVENTION

A chomping bubble producing toy including a shaft secured between a bubble solution reservoir and a housing. The housing is the shape of a character and includes an upper and lower jaw. The lower jaw is moveable via pulling of a lever, which is secured within the shaft. The lever is secured to a connection rod within the housing, which connection rod is secured to the lower jaw. When the lever is pulled, the connection rod moves upward, which pushes the lower jaw down about a fixed rotational axle. A compression spring is secured to the connection rod, which spring keeps the jaw closed when the lever is at rest. Secured within the housing adjacent to the connection rod is a lever switch. When the connection rod is moved by the pulling of the lever, it contacts the lever switch, thereby triggering it, which automatically plays sound from a speaker within the device and/or transmits a wireless signal.

DETAILED DESCRIPTION

Figure 1:
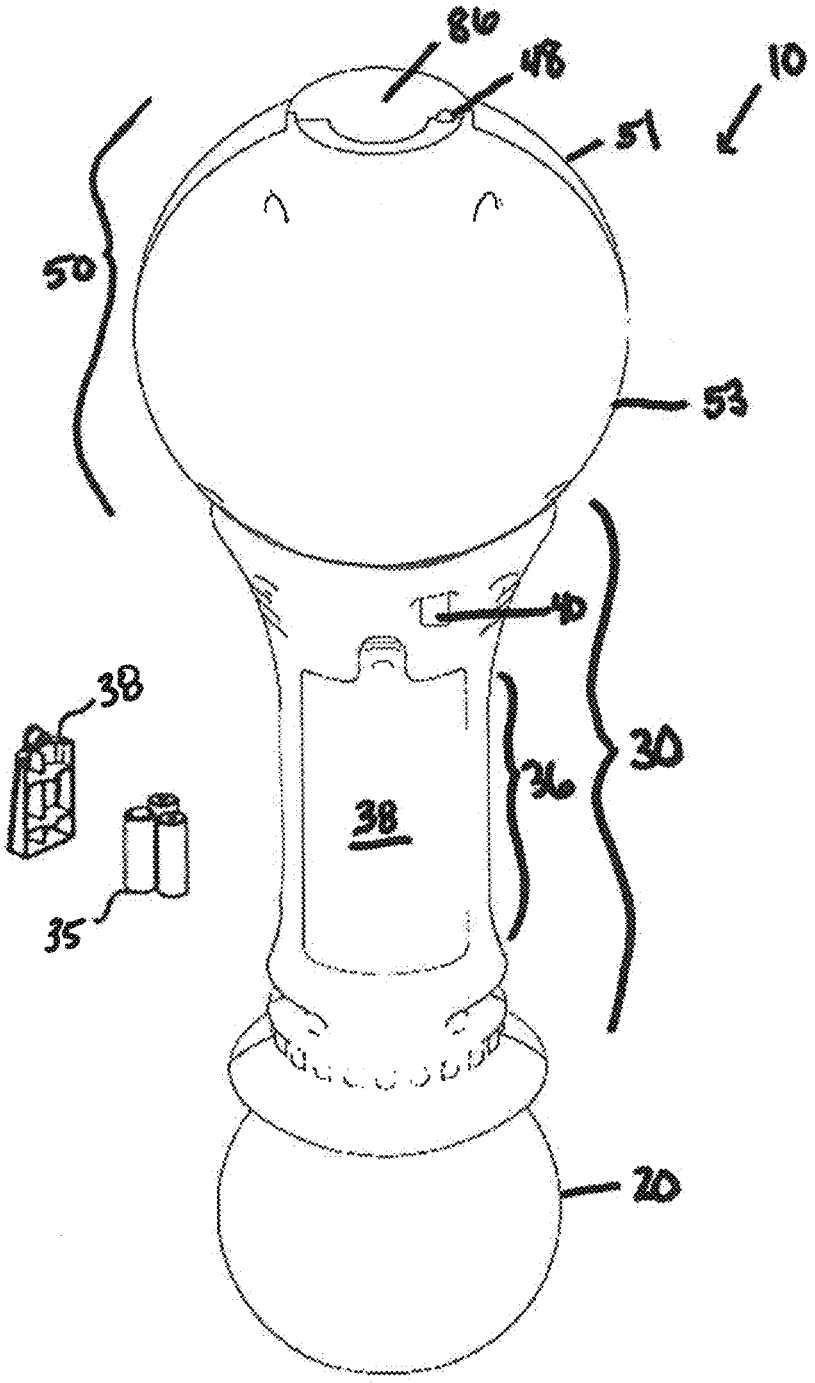
FIG. 1 is a back view of a first embodiment of a bubble producing toy including a bubble producing solution reservoir connected to a housing by a shaft.
Figure 2:
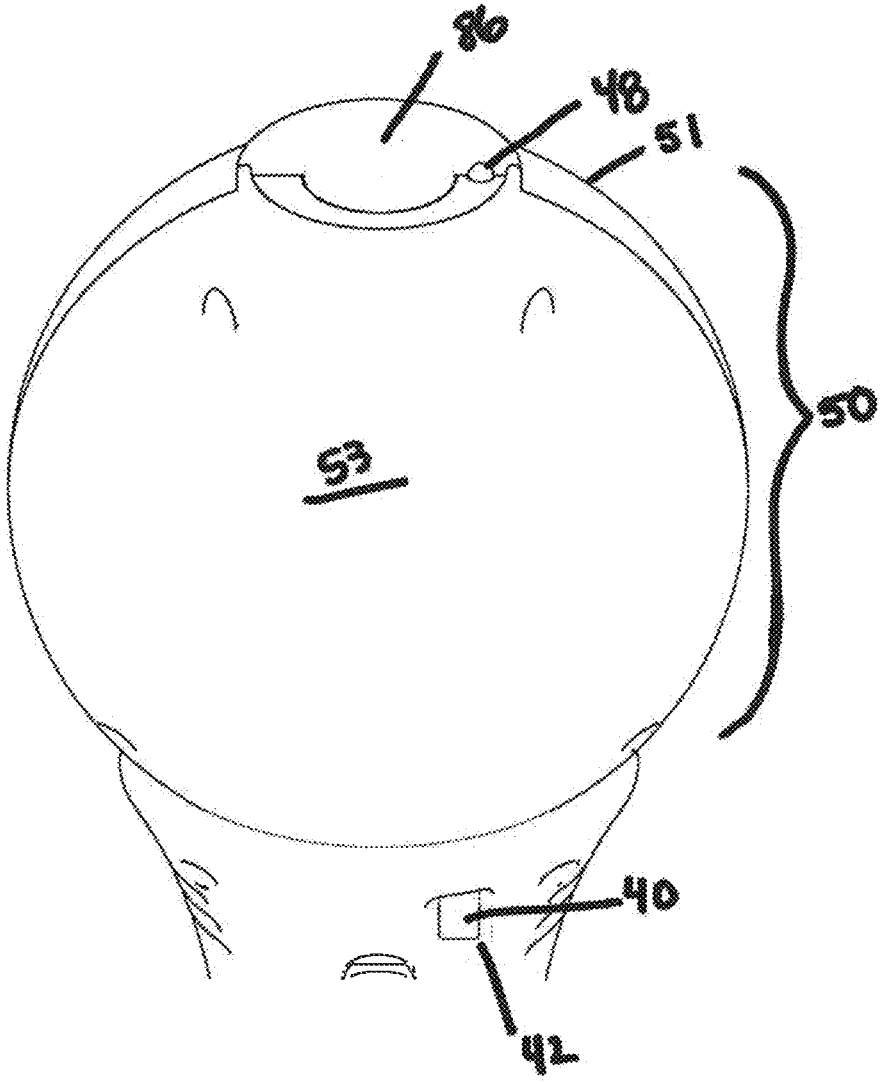
FIG. 2 is a back, perspective view of the housing of the bubble producing toy shown in FIG. 1.
Figure 3:
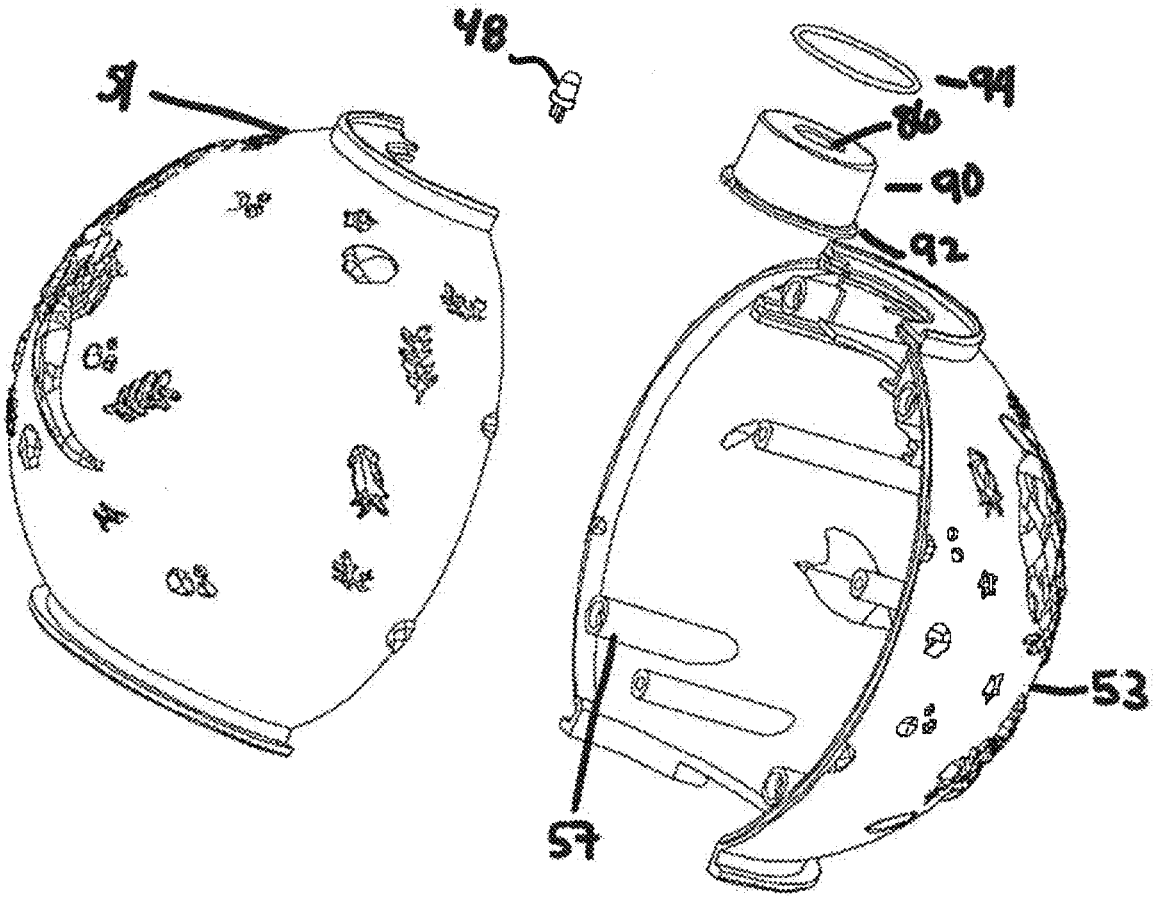
FIG. 3 is an open view of the housing with a nozzle of the bubble producing toy shown in FIG. 1.

FIGS. 1-10 show varying perspectives of a first embodiment of a bubble producing toy 10. FIGS. 15-22 show varying perspectives of a second embodiment of a bubble producing toy 200, wherein the toy includes a chomping mechanism. The components for generating bubbles are the same in the first and the second embodiment and the elements are correspondingly labeled in the Figures. Features and structures that are modified in the second embodiment are noted herein and are labeled in FIGS. 15-22 using the 200 series reference numbers. Any elements disclosed for the first embodiment shall be understood as applying to the second embodiment, even if not specifically shown in FIGS. 15-22. FIGS. 11-14 show a converter 100 that is utilized by both the first and the second embodiments of the bubble producing toy.

As shown in FIGS. 1 and 15-20, the first and second embodiments of the bubble producing toy (10, 200) include a bubble solution reservoir 20 that is connectable by a shaft 30 to a housing 50. The reservoir 20 contains liquid, such as bubble solution, that creates bubbles. The bubble solution is preferably nontoxic and is advantageous because it is less slippery when it falls to the ground. The reservoir preferably has a flat bottom, so the toy can be placed on a surface and not topple over. The reservoir is connected to the shaft by any conventional securing system, for instance by twisting or rotating the reservoir onto the shaft. The reservoir is refillable, which is advantageous as the toy can be used indefinitely.

As shown in FIGS. 10, 15-16, and 19-20 the reservoir 20 includes a cover 22, that connects to a top portion thereof, and prevents solution from spilling out of the reservoir into the shaft 30. One way in which the cover connects to the reservoir is via sides 21 that protrude downwardly from the cover and secure within the reservoir or around the reservoir. The cover includes an opening 28 for the connection of a solution channel 26 through which solution submerged within the reservoir is pumped or passed. The channel is connected to the opening by conventional methods and one end of the channel is located within the solution of the reservoir. The channel includes a tubular structure that runs vertically from the reservoir, through the shaft 30, through a pump 60 with a gearbox 62, which are secured within the housing 50, and connects to a nozzle 72 secured in a top portion of the housing.

As shown in FIGS. 10, 15-16, and 19-20, the opening 28 may be connected to or include a converter 100. As shown in FIGS. 10-15 the converter includes a first end 102 and a second end 104, and each end includes a tip 106, 108. The solution channel 26 includes two tubular portions of differing diameters that are connected via the converter. As shown in 12-14, the larger diameter channel 112 connects to the tip of the first end of the converter. The larger diameter channel preferably has a larger inner diameter through which the solution is passed. The end of the larger diameter channel that is not connected to the converter is connected within the solution reservoir 20. The converter can be located anywhere within the length of the solution channel but is preferably connected to or secured into the opening in the cover of the reservoir. Further, the recirculation channel 29 can include a converter therein. The converter is form-fitted into this opening or secured, for instance, via glue. The second end 104 of the converter also includes a tip 108 that is connected to a smaller diameter solution channel 114 that is of a smaller diameter than the larger diameter channel. The smaller channel is reduced in diameter from the larger channel by at least ten percent, preferably about ten to seventy percent, most preferably about ten to fifty percent. The end of the smaller diameter channel that is not connected to the converter runs vertically through the shaft 30 through a pump 60 with a gearbox 62 secured within the housing 50. The solution within the reservoir is pumped through this channel and the channel eventually merges with and connects to an outlet 78 located within a trough 76 of the nozzle 72.

As shown in FIGS. 10-15 the converter 100 includes a middle body portion 110 that is located between the tips 106, 108 of the converter. The converter is molded as one continuous piece during production. The larger and smaller diameter solution channels 112, 114 are suction fitted onto the respective tips of the converter and can be further secured by other methods. The middle body portion aids in this securement. The diameter of the smaller diameter solution channels 114 is of a reduced size to reduce the quantity of solution that passes through the channel, which ultimately produces the desired drip rate of the fluid onto the trough 76 of the nozzle 72. The converter 100 functions to reduce the quantity of the solution and the size of the opening through which the solution passes. The converter reduces the quantity of passing solution by at least ten percent, preferably about ten to seventy percent, most preferably about ten to fifty percent.

Figure 10:
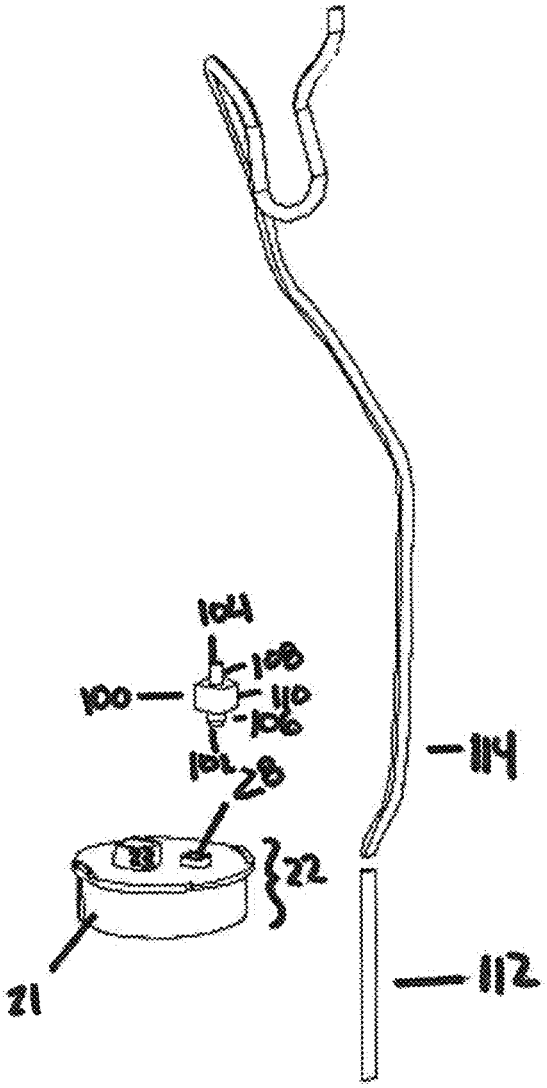
FIG. 10 is a back view of the solution channel and cover of the solution reservoir of the bubble producing toy shown in FIG. 1.
Figure 11:
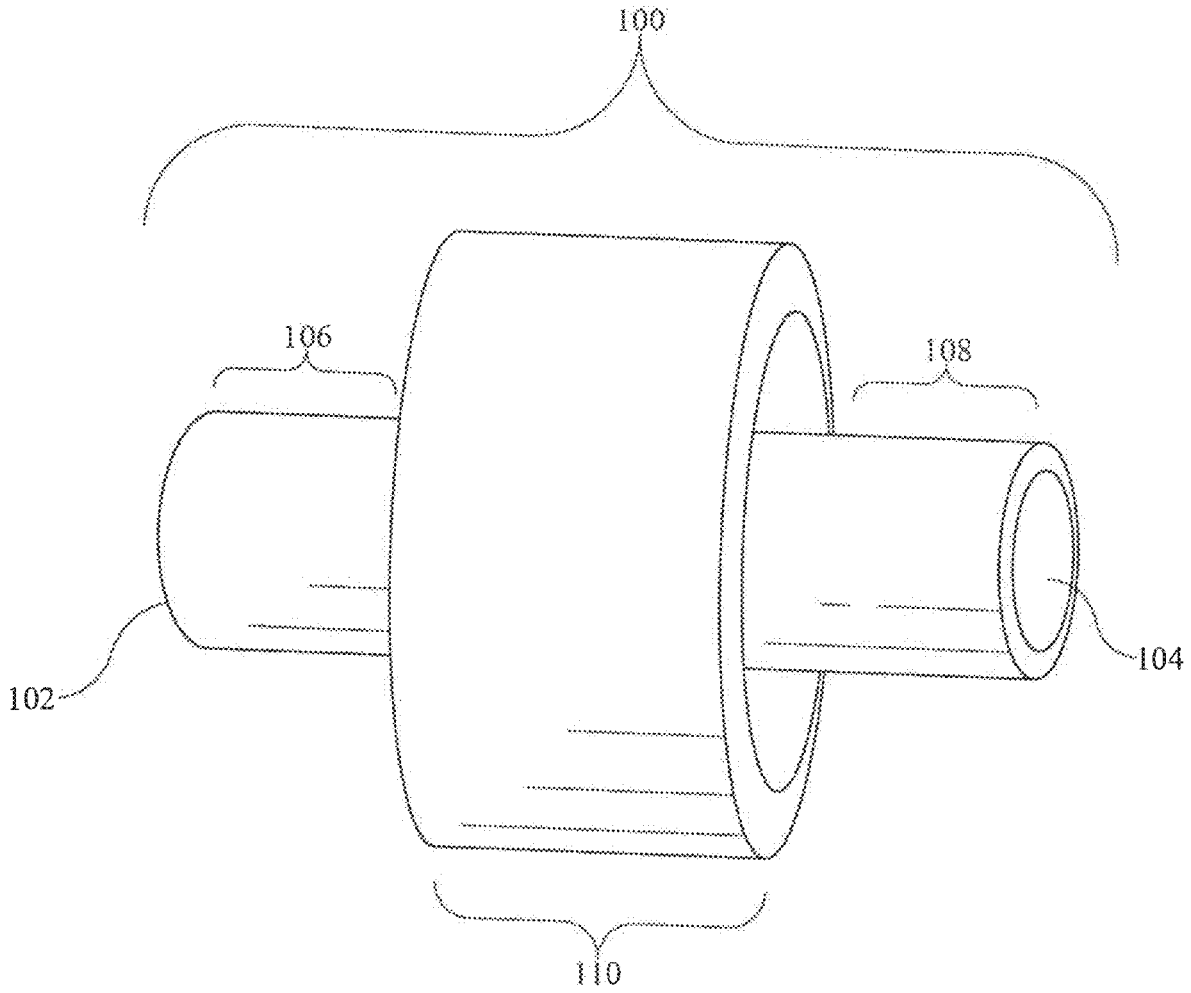
FIG. 11 is a side view of a converter that is used in combination with a solution channel of the bubble producing toy shown in FIG. 1.
Figure 12:
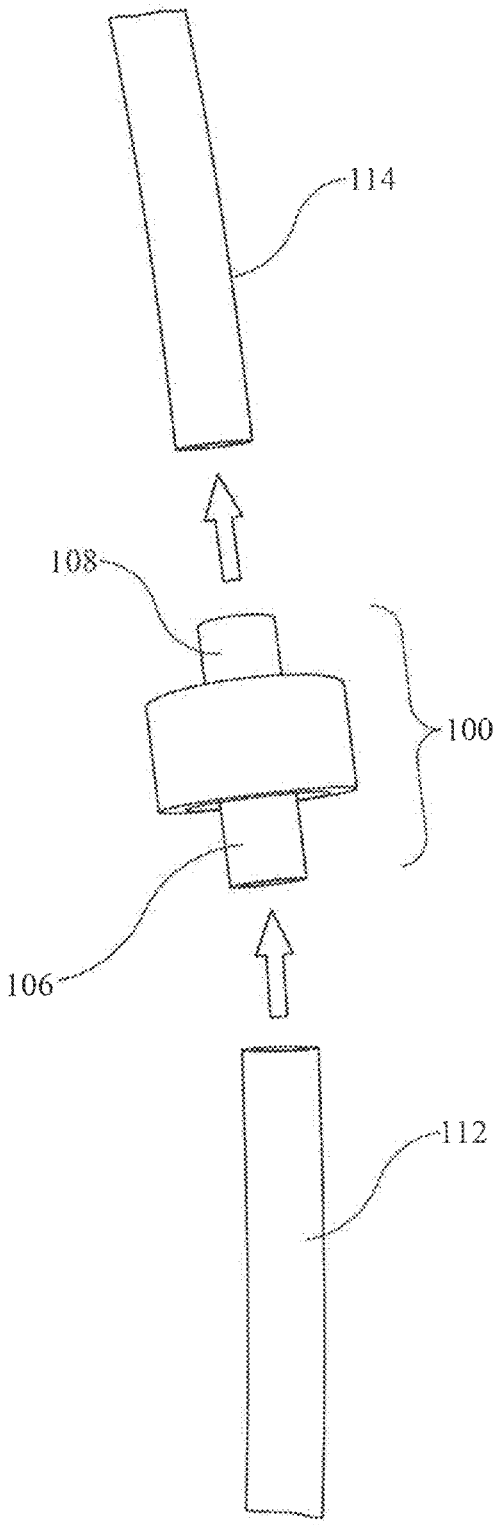
FIG. 12 is a front view of the converter of FIG. 11 with a solution channel that has two pieces with different diameters.
Figure 13:
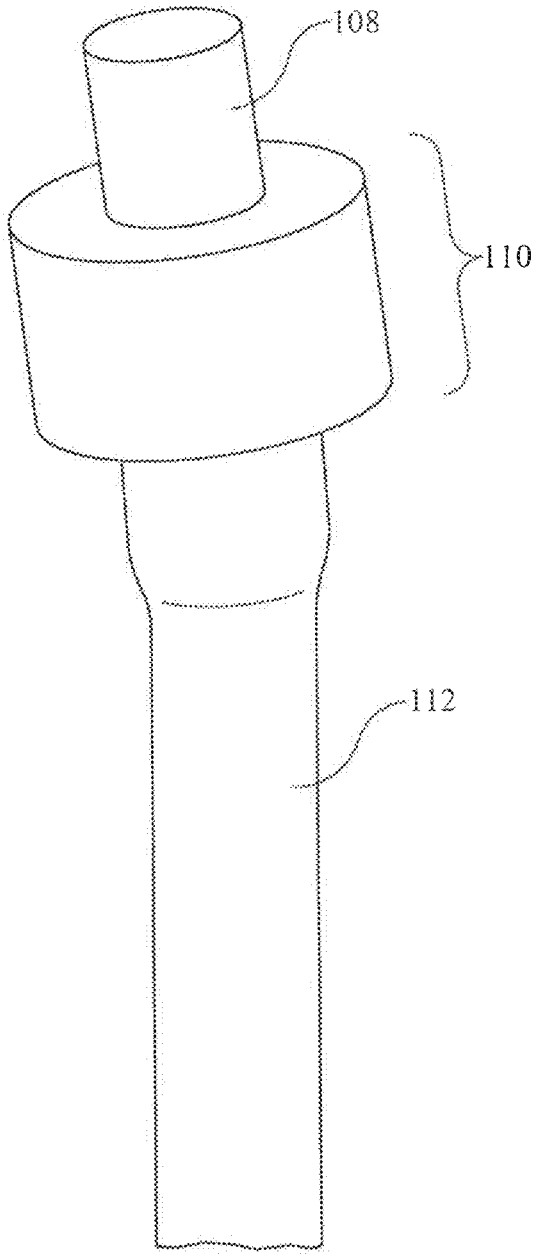
FIG. 13 is a front view of the converter of FIG. 11 connected to a larger diameter piece of the solution channel.
Figure 14:
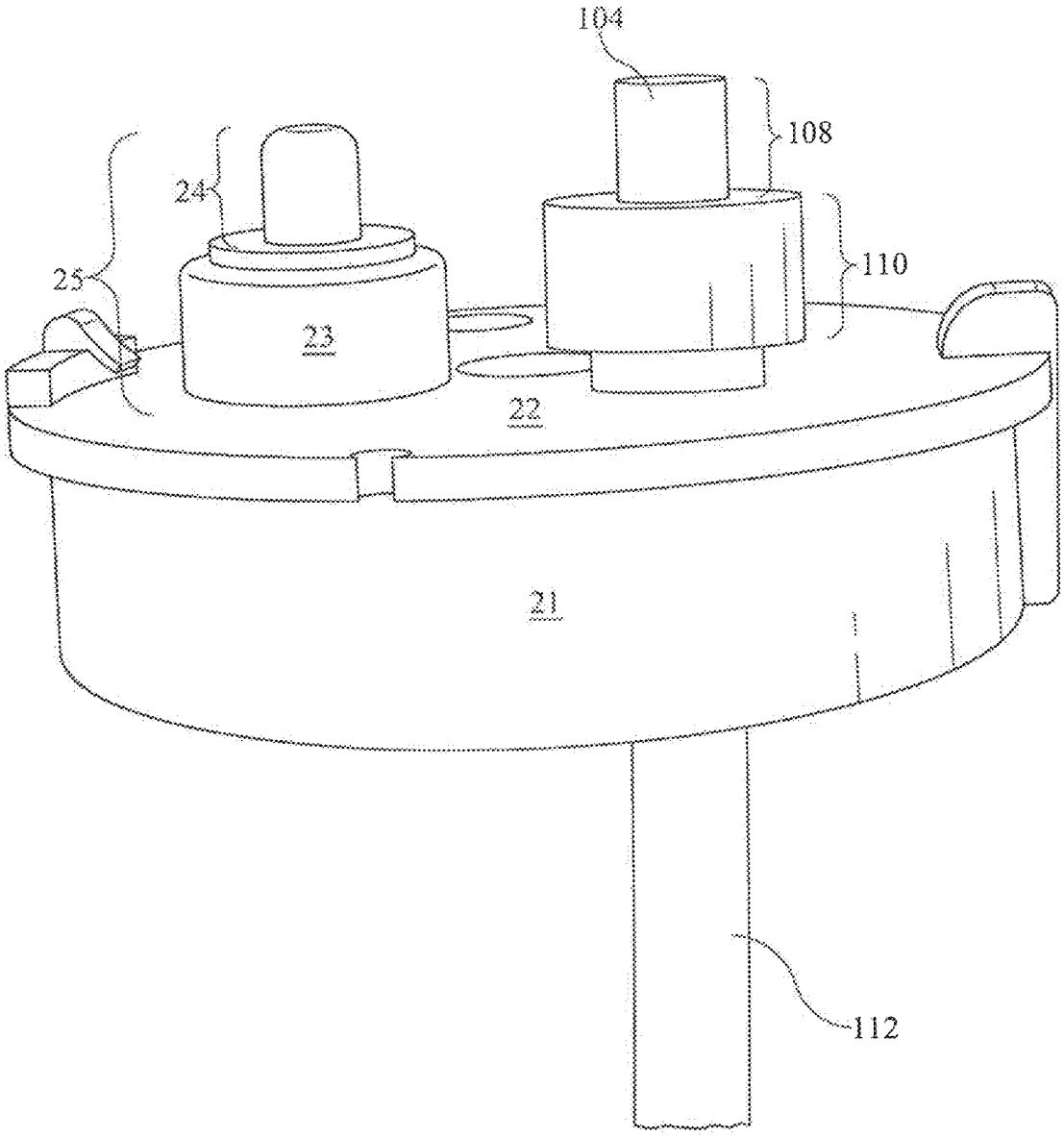
FIG. 14 is a front view of a reservoir cover of the bubble producing toy of FIG. 1 connected to the converter and larger diameter piece of the solution channel shown in FIG. 13.
Figure 15:
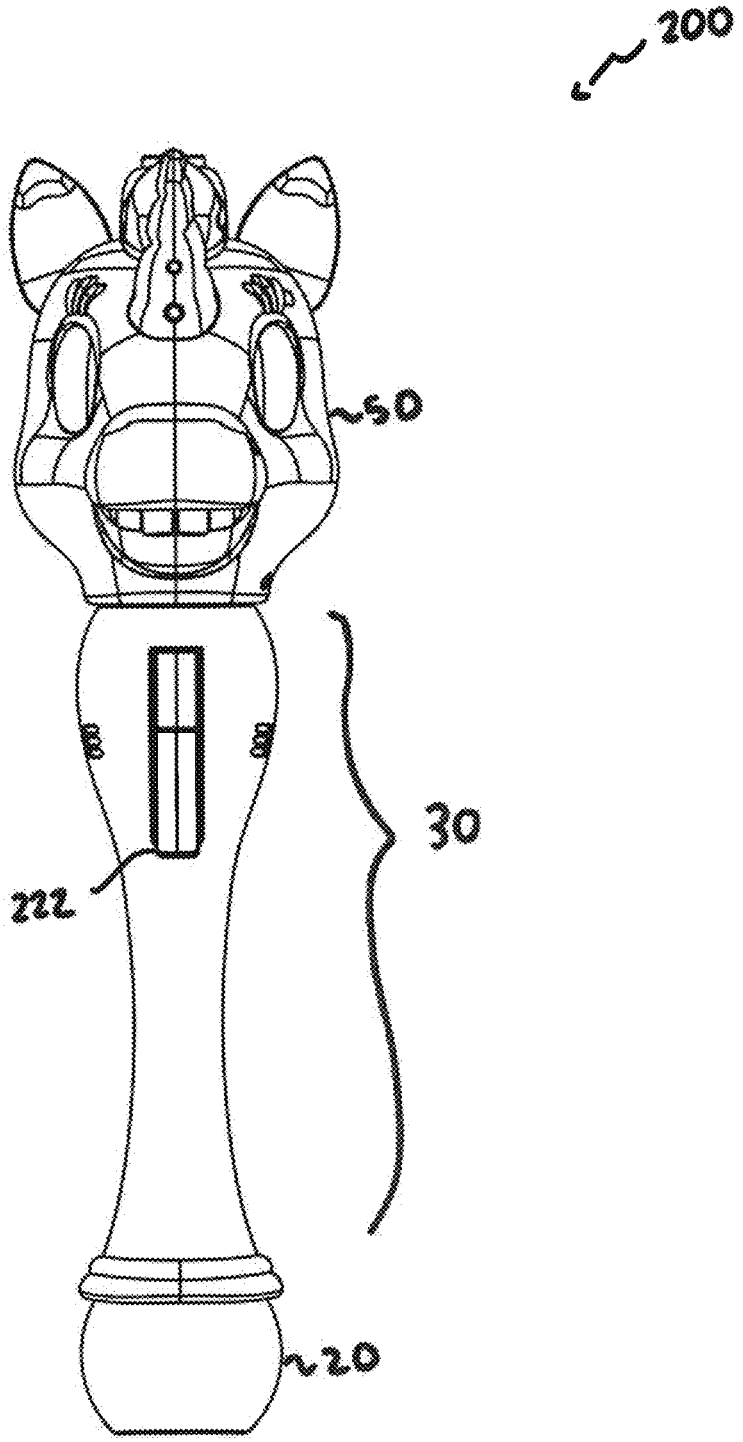
FIG. 15 is a front view of a second embodiment of a bubble producing toy, which includes a bubble solution reservoir connected to a housing by the shaft, wherein the shaft includes a lever that activates a chomping mechanism of the toy.

As shown in FIGS. 10 and 14, the cover 22 of the reservoir 20 also includes a recirculation channel connection 25 that includes a tip 24, that is connected to the cover by a body portion 23. The converter 100 is used in conjunction with or in place of the recirculation channel connection toy. The tip connects to a solution recirculation channel 29 that includes a tubular structure that runs vertically downward through the shaft 30 to permit excess solution produced during operation of the toy 10 to drain back into the reservoir for reuse. The solution recirculation channel is advantageous because it recycles solution, so it is not wasted. Further, the recirculation channel collects excess liquid that is caught in trough 76 of the nozzle 72 and safely returns it to the solution reservoir. This prevents leakage of the excess solution into the inner electronics of the toy. The body portion of the recirculation channel connection includes a ball valve or ball bearing, so that if a user turns the toy upside down, liquid is prevented from leaking out of the reservoir.

Figure 4:
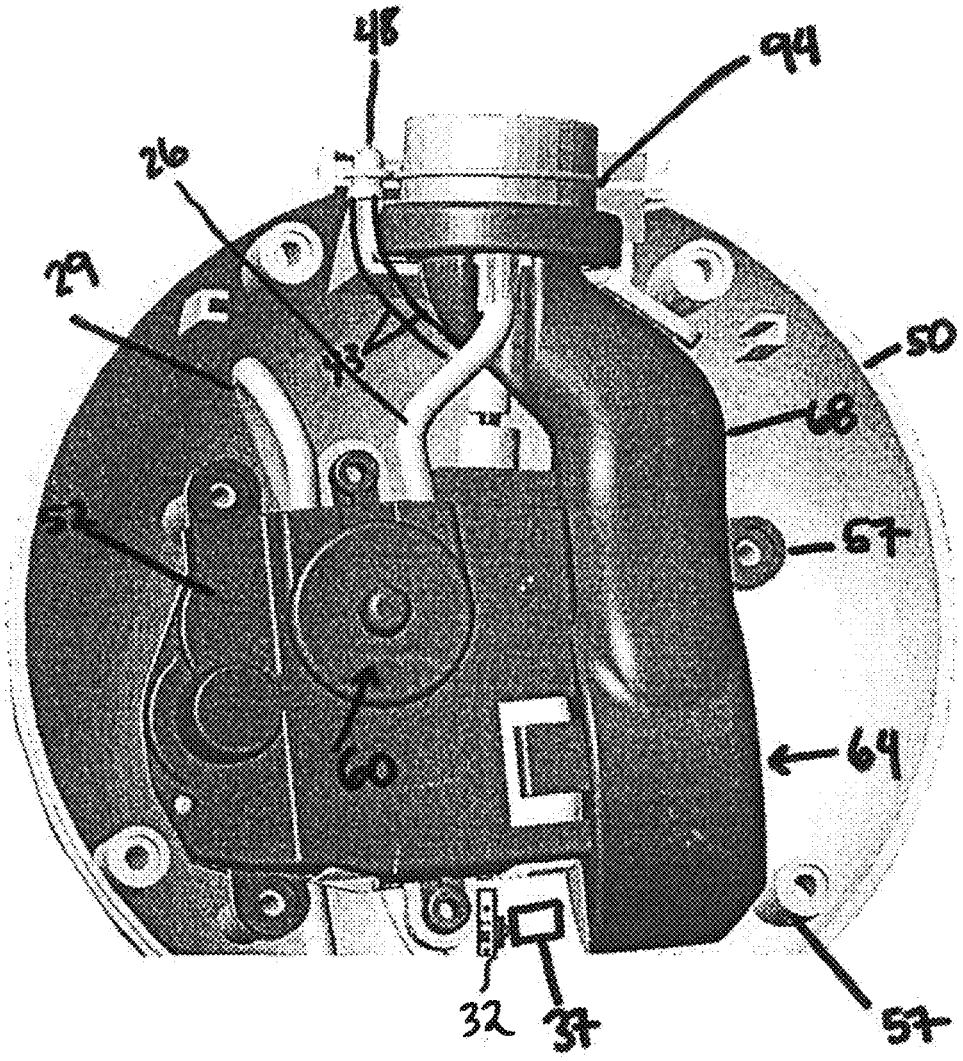
FIG. 4 is an open view of the housing of the bubble producing toy shown in FIG. 1 with electrical components secured within an enclosure.
Figure 5:
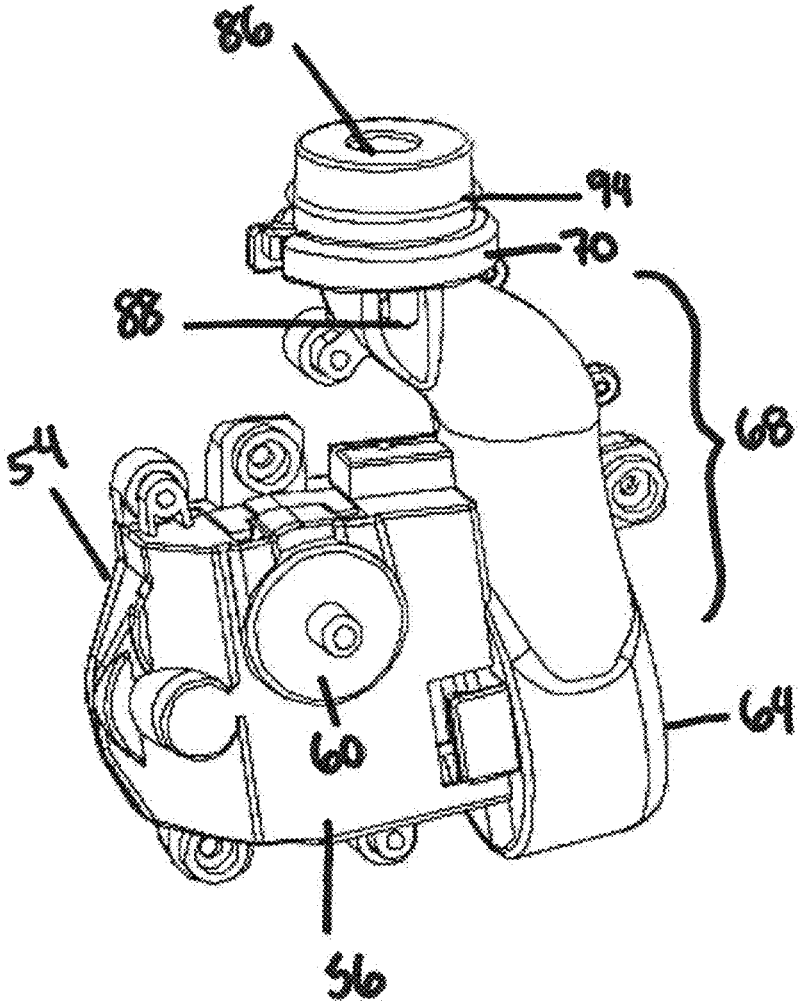
FIG. 5 is a back view of the enclosure that contains the electrical components of the housing of the bubble toy shown in FIG. 1.
Figure 6:
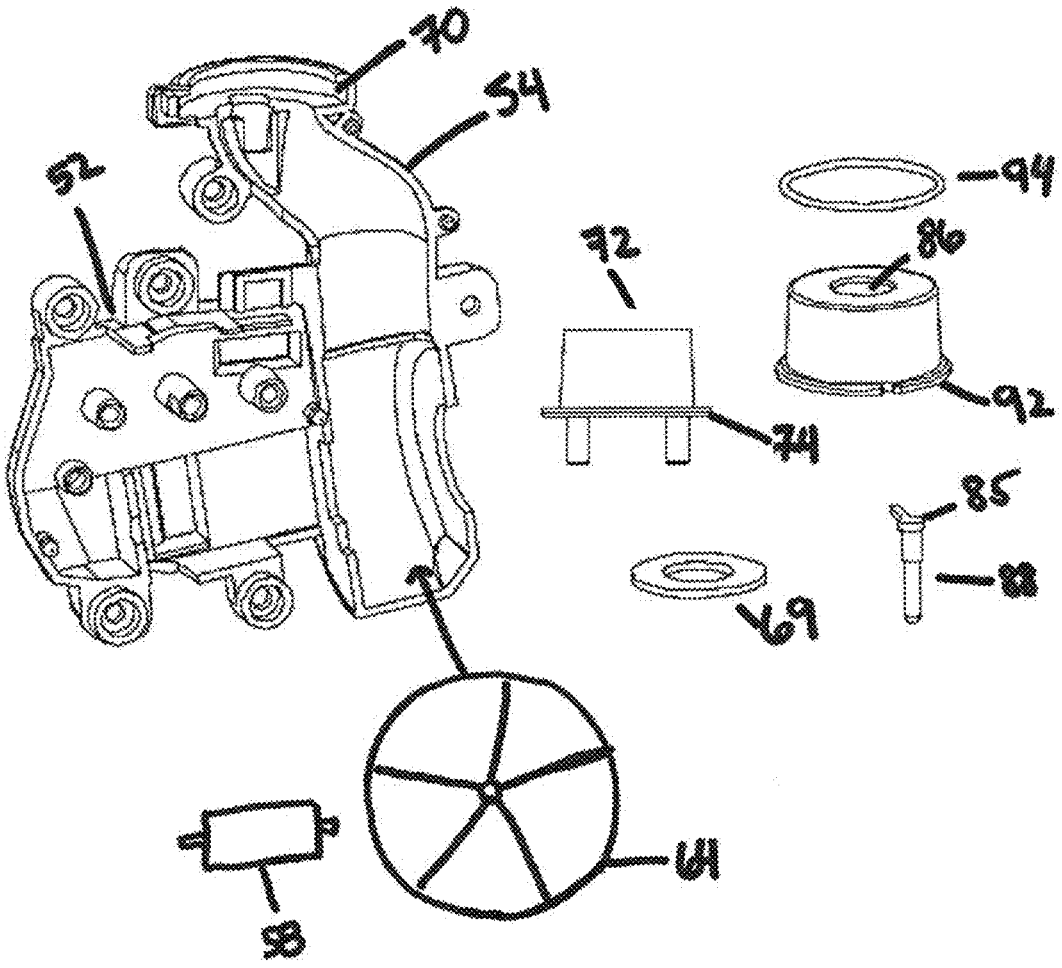
FIG. 6 is a back, open faced view of the enclosure of the bubble producing toy shown in FIG. 1 with the nozzle, a nozzle cover and a wiper mechanism.
Figure 22:
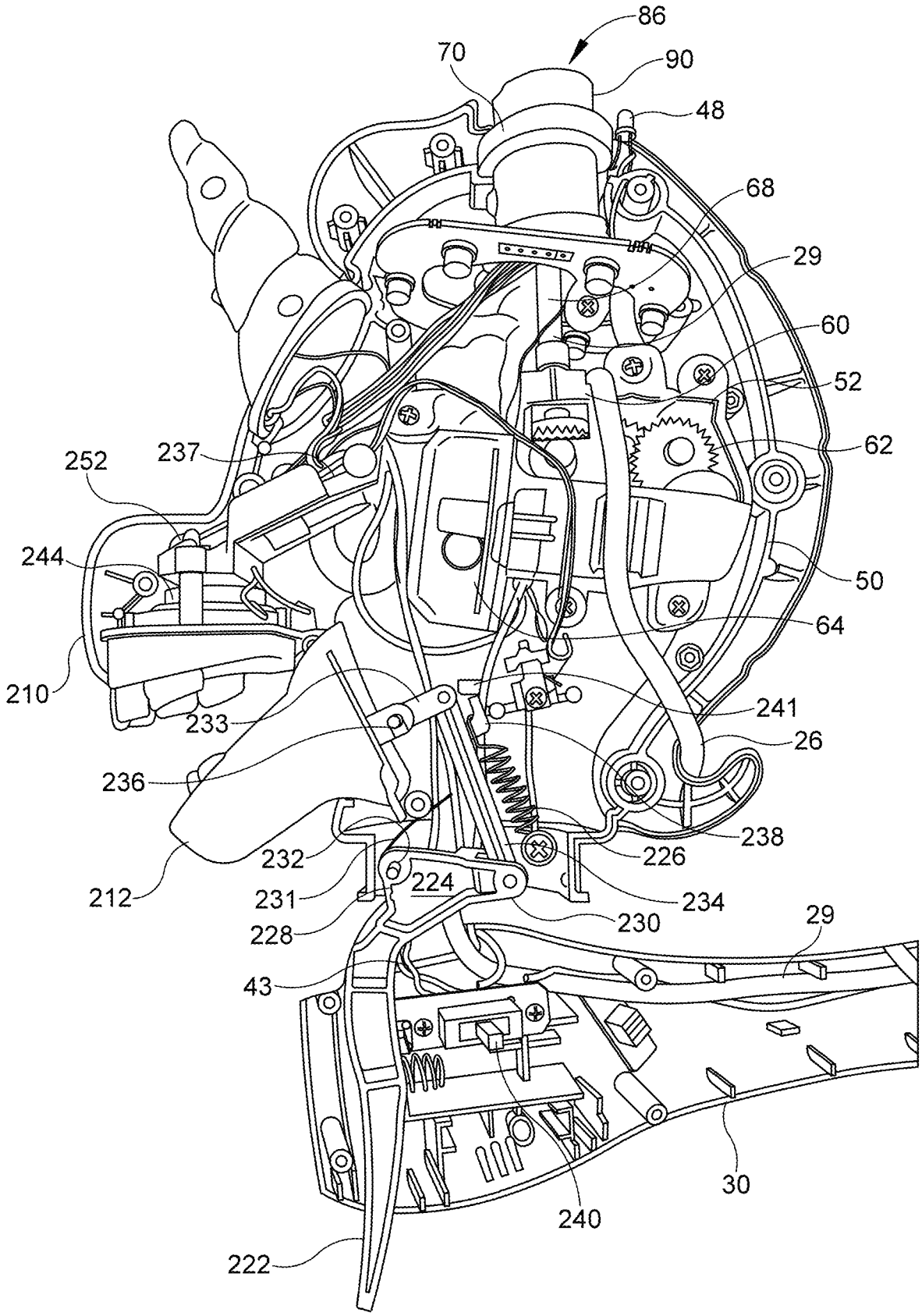
FIG. 22 is another side, cross-section view of the second embodiment of the bubble producing toy shown in FIG. 15, wherein the chomping mechanism is activated.

As shown in FIGS. 1 and 15-20, the shaft 30 is preferably connected to a top portion of the reservoir 20 via a twisting or screwing mechanism. The shaft is shaped as a handle for the user to comfortably hold the toy (10, 200). The shaft is preferably made of a lightweight, but durable, material, such as plastic that can withstand being dropped without breaking. The shaft is hollow and can be made of one monolithic piece or may consist of a front and back cover secured together, for instance via screws. The shaft includes a power source for operation of the toy, which power source is batteries 35. The batteries are secured within a battery compartment 36, which is formed within the back side of the shaft and encloses the batteries via a casing 38. As shown in FIGS. 4 and 22, the shaft includes wiring 43 that electrically connects the power source to the electrical components of the toy, most of which are secured within the housing 50. In the first and the second embodiment of the toy, the batteries are electrically connected to a push slide switch (40, 240), which a user presses to activate various features of the toy. The battery compartment includes a fuse that protects the power source from overheating by cutting the power source if temperature rises above safety requirements. This switch in both the first and second embodiment is multi-functional and preferably a three-way slide switch, and thereby controls multiple settings of various electrical operations of the toy. For example, in the first embodiment, as shown in FIGS.

1-4, for the toy includes an LED(s) 48 secured within the toy, which LEDs vary in color, luminosity, and intensity. In one manner of operation, when a user slides the switch up, the LEDs illuminate in a sequence that varies in color, luminosity, etc. and bubbles are produced. When a user slides the switch down, the LEDs are continuously illuminated, and bubbles are produced.

As shown in FIGS. 4 and 19-22, the first and second embodiment of the toy (10,200) includes circuitry or control circuitry (37, 237) such as a microcontroller unit, that controls the various electrical operations of the toy. The microcontroller unit further incorporates a proximity detection device, such as, for example, RFID or other types of electronics, which sense location, proximity or other wireless operations which provide instructions for illumination, sound production, and/or bubble production. Such devices include instructions and circuitry operable to detect location in respect to a transmitted beacon. The toy further includes a vibrational element. For example, the first and second embodiment of the toy includes wireless activation via an IR receiver 248 and also transmits signals via an IR transmitter 246 when the toy is within a certain distance of a display, feature, attraction of other location, see FIGS. 19-21. For example, the toy automatically activates upon nearing a display, feature, attraction, or other location within an amusement park which is transmitting a unique beacon which, when received by the toy, causes the toy to illuminate, play sound and/or produce bubbles produce bubbles in a preprogrammed manner. Other possible automated instructions include emitting colors, playing predefined audio stored in memory of the toy or received by the receiver of the toy, playing signals which are streamed and received by the integrated receiver, and similar functionality. Further, when a user with the toy nears a display, feature, attraction, or other location which can receive a unique beacon being sent from the toy, the display, feature, attraction etc. illuminates and/or activates in a predetermined manner.

As shown in FIGS. 1-3 and 19, the housing 50 includes a front 51 and back 53 casing that are secured together, for example by screws. The housing can be any shape or size. As shown in FIGS. 1-4, the housing of the first endowment of the toy 10 is a globe shape in the first embodiment of the toy 10. As shown in FIG. 15-22, the housing of the second embodiment of the toy 200 is a unicorn with a face including eyes, ears and a mouth. More particularly, in the second embodiment, the mouth includes an upper jaw 210 and lower jaw 212 which lower jaw moves away from the upper jaw, thereby opening and closing the mouth of the unicorn when a lever 220 is pulled. As shown in FIGS. 4, 5, 9, and 22, the bubble producing components of the housing are secured within an enclosure 52, which enclosure is secured to an inner surface of the housing. This enclosure is water resistant or waterproof and advantageously aids in protecting the electrical components from being damaged by liquid. As shown in FIG. 4, the enclosure is secured via screws to various pegs 57, which prevents the enclosure from shifting within the housing. The enclosure is one piece or includes a front cover 54 and a back cover 56, which are secured together, for instance via screws. The enclosure is configured in any predetermined shape so that, when the front and back covers are secured together, the various components therein are secured in place. The enclosure is configured to contain a motor 58 that is electrically connected to a pump 60 with a gearbox 62 and an air producing toy 64. The motor can be any type of motor that most effectively produces the amount of energy needed to create the precise number of rotations necessary to generate the desired quantity of bubbles. Advantageously, the rotational speed of the motor is reduced to a specific rpm so that there is less solution on the nozzle 72 of the top portion of the toy, which avoids solution overflow into the toy. Further, this motor also generates the necessary air flow rate to create the desired quantity of bubbles. Further, the toy advantageously uses less electric current because of the slowed speed of the motor, therefore increasing battery life of the toy. To further aid in producing the desired size and quantity of bubbles is the type of pump 60 used, which is preferably a peristaltic pump. This pump is connected to the gearbox 62, which includes a plurality of gears for controlling the speed of the pump to produce the correct number of bubbles per minute. The pump operates in combination with the gearbox, which draws the bubble solution from the reservoir 20 through the channel 26. The channel extends from the reservoir, through the shaft 30, the pump and the gearbox. A second end 27 of the channel secures to an outlet 78 located in a trough 76 of a nozzle 72. The air combines with the solution close to the discharge orifice 86 of a nozzle cover 90 and is advantageous in creating the desired quantity and size of bubbles. The motor is electrically connected to the air producing toy. The air producing toy can be any toy that produces an air stream with the velocity needed to project the solution through the discharge orifice 86 of the nozzle cover 90. The air duct is a hollow tube that is secured to, part of, or formed by the enclosure 52. The air duct is bent at an angle to aid in creating the precise number of bubbles to not overheat the toy.

Figure 7:
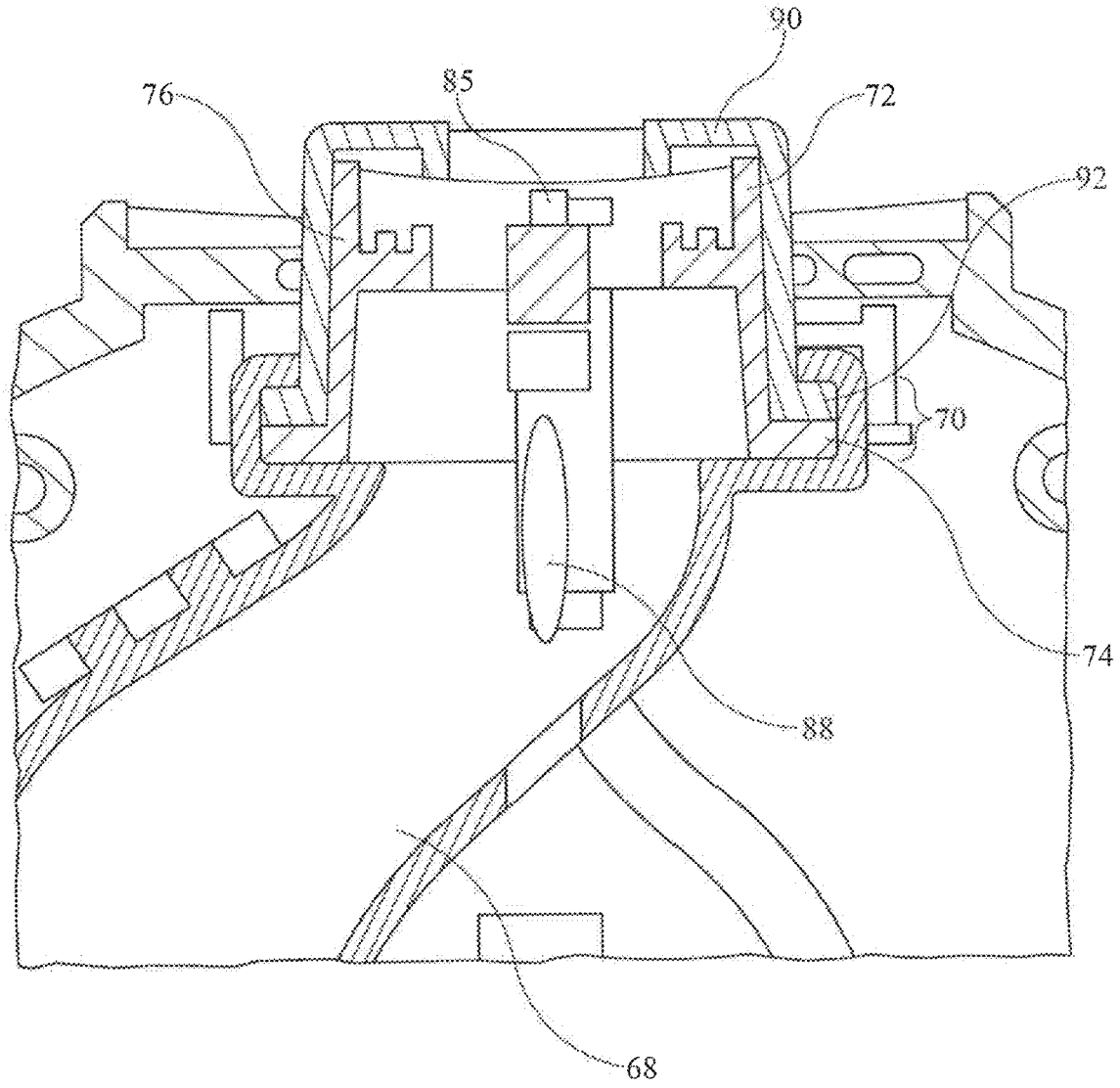
FIG. 7 is a cut-away view of the nozzle, nozzle cover and air duct secured within the housing of the bubble producing toy shown in FIG. 1.
Figure 8:
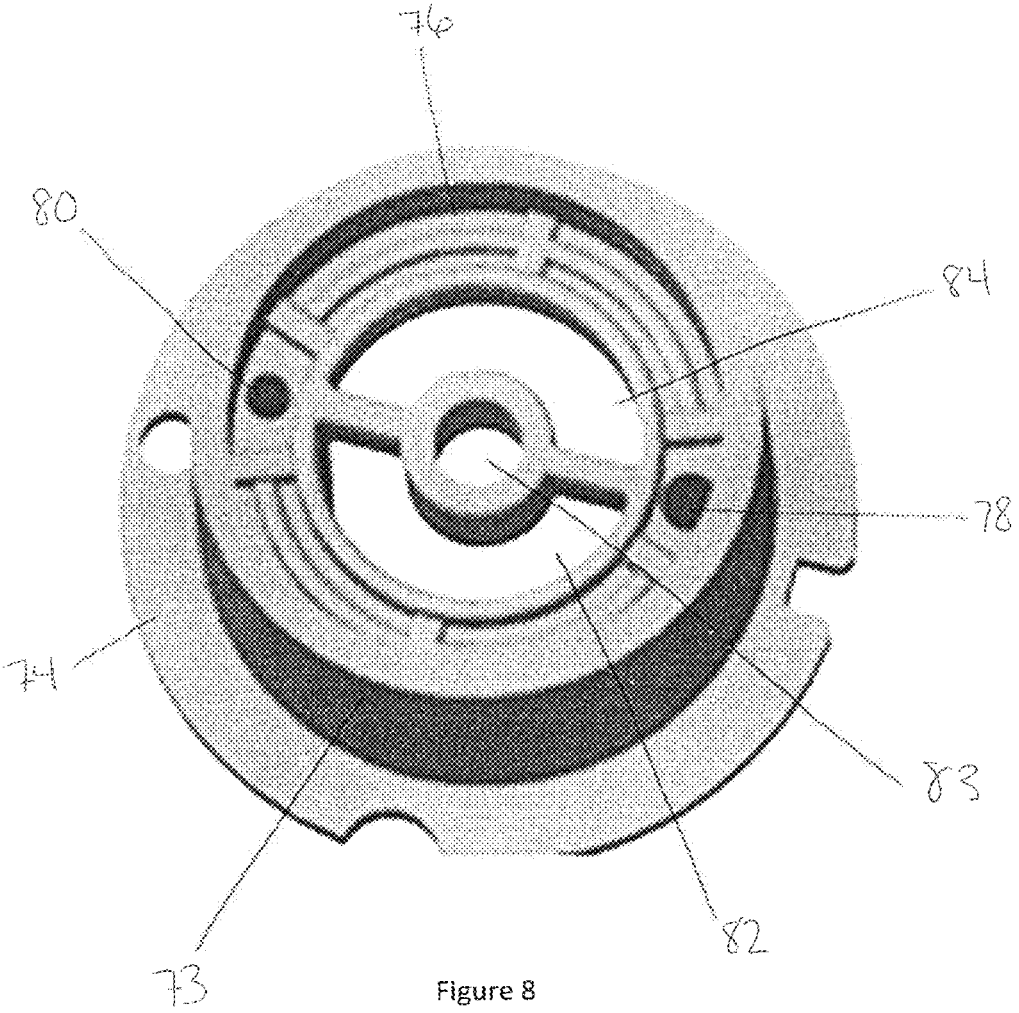
FIG. 8 is a top perspective view of the nozzle of the bubble producing toy shown in FIG. 1.
Figure 9:
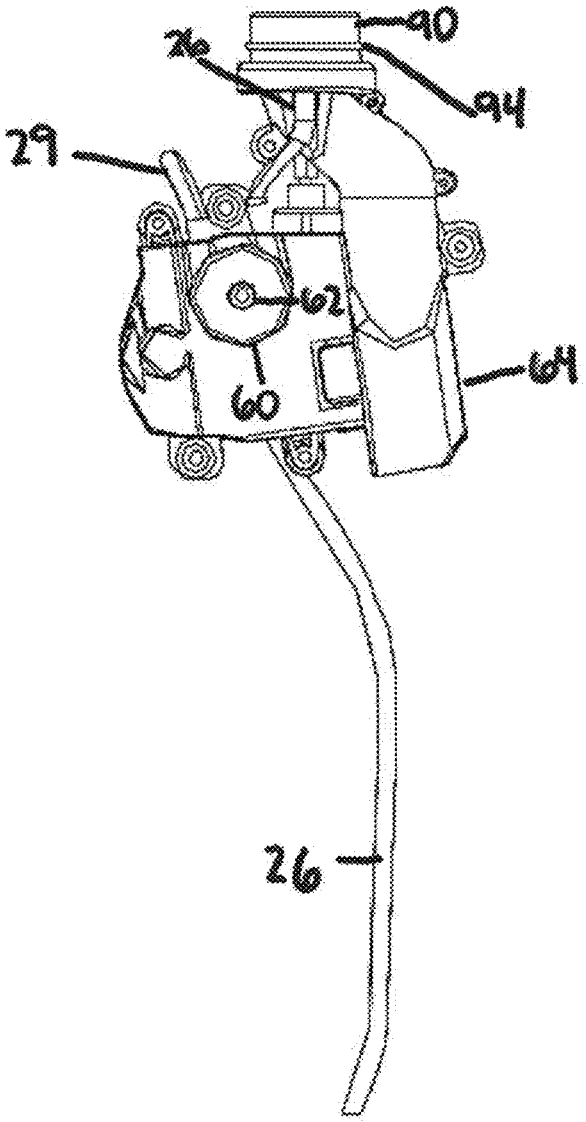
FIG. 9 is a back view of the enclosure, nozzle and solution channel of the bubble producing toy shown in FIG. 1.
Figure 19:
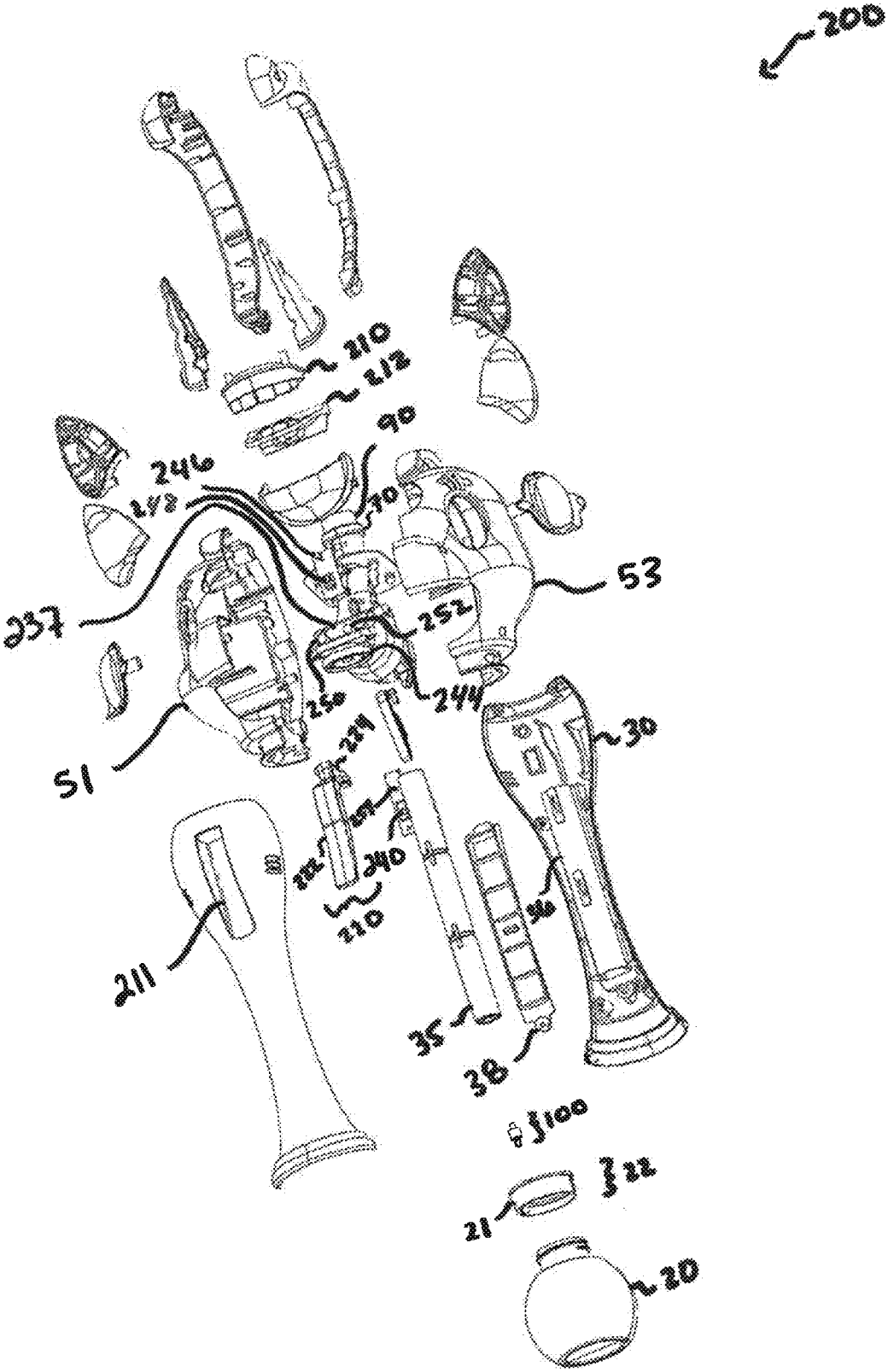
FIG. 19 is an exploded view of the second embodiment of the bubble producing toy shown in FIG. 15.
Figure 20:
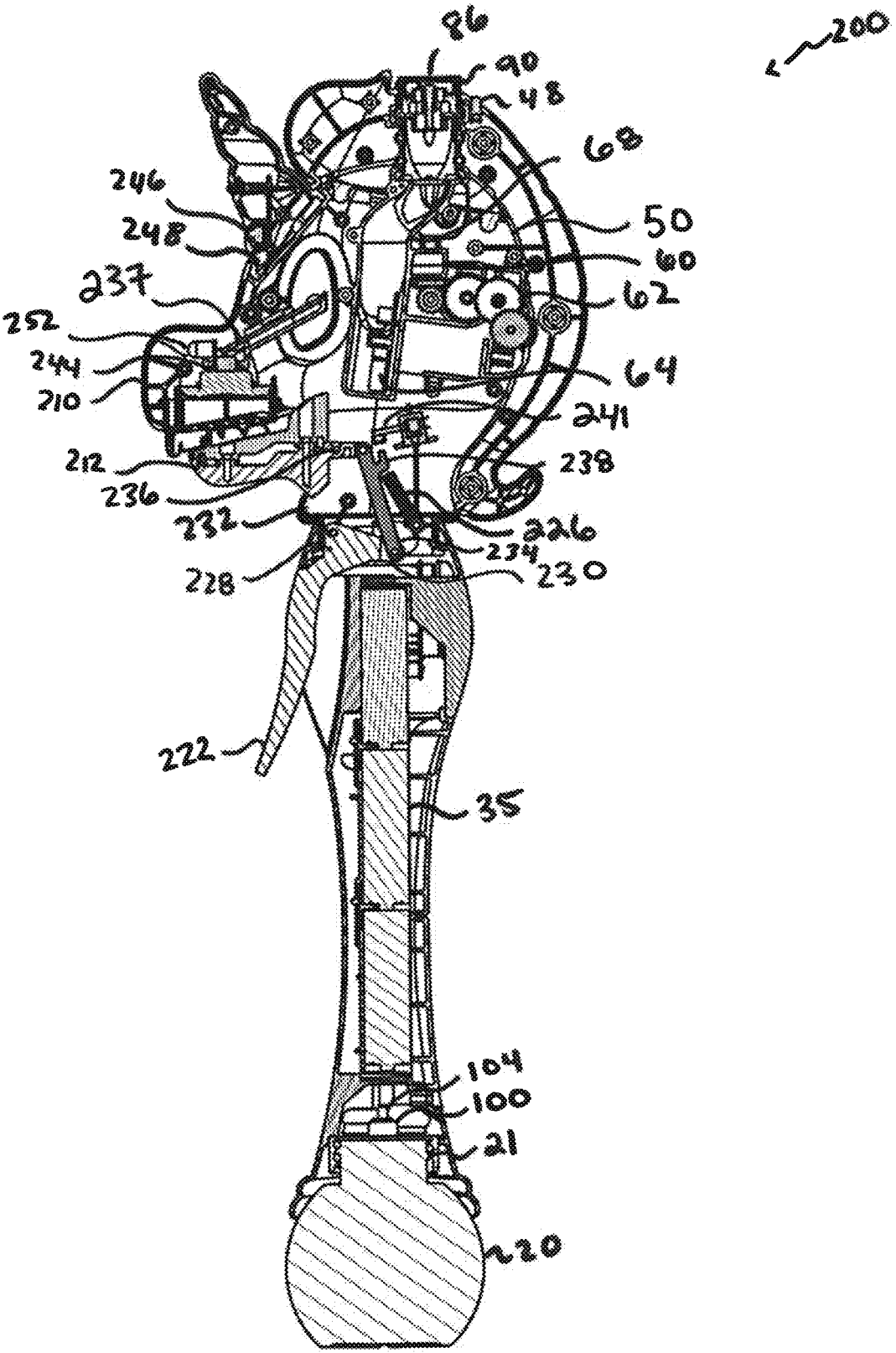
FIG. 20 is a side cross-section view of the second embodiment of the bubble producing toy shown in FIG. 15.
Figure 21:
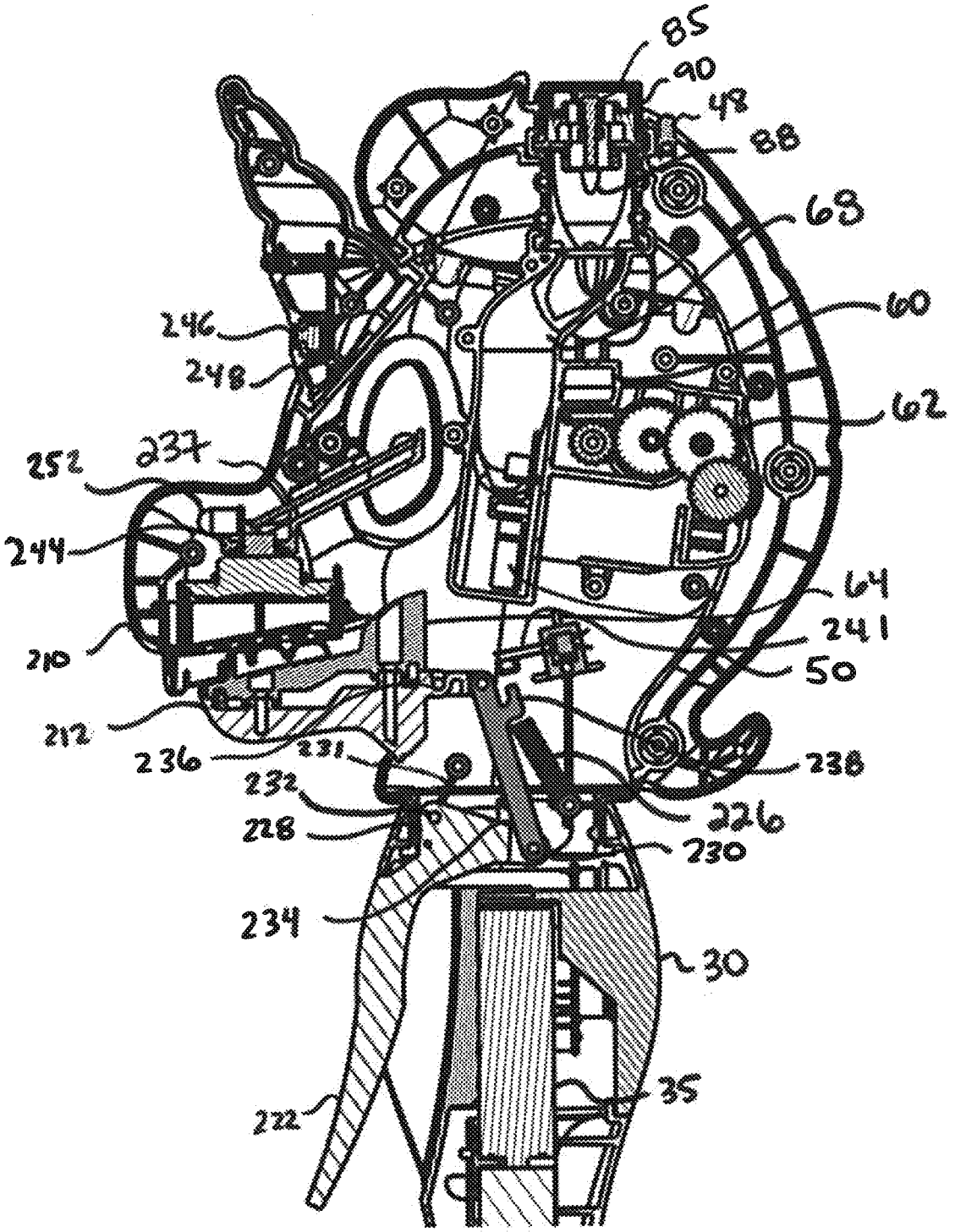
FIG. 21 is a side cross-section view of an upper portion of the shaft with the lever and the housing of the second embodiment of the bubble producing toy shown in FIG. 15.

As shown in FIGS. 7 and 19-22, a top portion of the air duct 68 is connected to or includes a bracket-shaped shelf 70. As shown in FIGS. 7 and 21, the bracket shape of the shelf is manufactured to securely fit a base portion 74 of the nozzle 72 and a base portion 92 of the nozzle cover 90. The base of the nozzle is secured underneath the base of the cover, which fits together snuggly in the shelf. If further reinforcement is needed, screws can be utilized or a nozzle sealing sheet 69 may be used to seal the bases within the shelf. Extending from the base of the nozzle is an upper portion 73, which includes a trough 76 that surrounds the outer circumference of the upper portion of the nozzle. This trough includes an outlet 78 to which the bubble solution channel 26 connects and an inlet 80 to which the recirculation channel 29 connects. As shown in FIG. 9, each channel connects to an underside of the inlet and outlet. As shown in FIG. 8, inwardly located from the trough are two semicircle openings 82, 84. Air from the air duct is pushed upward through these two semicircle portions. Although these two open semi-circle portions can be any shape, the semi-circle shape is most beneficial for the 360-degree rotation of the wiper 85, which is centrally located within the nozzle via a central portion 83. The wiper shaft 88 is secured within the central portion and extends into the housing 50. When rotating, the wiper extends to the trough and rotates over the two semicircle openings to create bubbles. For example, in use, a user turns on the bubble toy (10, 200), which activates the internal electronic components of the toy, such as the motor 85, the air producing toy 64 and the pump 60. Solution is pumped from the solution reservoir 20 via the solution channel through the shaft 30 and to the outlet located within the trough of the nozzle. Solution then collects in the trough and as the wiper rotates 360 around the entire trough, a film is created on the two semi-circle portions. Subsequently, air from the air producing toy is pushed upwardly through the air duct and beneath the two semicircle portions. The air pushes the film into a bubble, which bubble is pushed out of the discharge orifice 86 in the nozzle cover. Further secured to an outer portion of the nozzle cover is a gasket 94 or searing toy that presses against the housing to make the toy water resistant. This gasket advantageously prevents any liquid from entering the toy.

As shown in FIGS. 15-20 the second embodiment of the bubble producing toy 200 includes a chomping feature, wherein the lower jaw piece 212 of the unicorn shaped housing 50 moves up and down to mimic a mouth chomping when a user pulls a lever 220. The upper jaw piece 210 does not move. As shown in FIG. 22, the lower piece includes a support 233 secured thereto within the housing, which support connects to the elements within the housing that cause the lower jaw piece to move. As shown in FIGS. 19-22, the lever includes a handle 222 and an arm 224. The arm is secured within shaft and the handle is the portion that a user pulls to activate the chomping mechanism. The handle is secured within a notch 211 within the shaft, so the lever has space to move when pulled by the user. When the lever is at rest, the upper and lower jaw are clamped together as shown in 15, 17-18 and 20-21. When a user pulls the lever into the notch, the bottom jaw opens, as shown in FIG. 22. This chomping feature is achieved via components secured within the shaft and housing. As FIGS. 20-22, the arm of the lever includes a front end 228 and a rear end 230. The front end includes a fixed rotational axel 232, about which the lever rotates via a wire 231 when the user pulls the handle. The rear end is pivotably connected to a first end of a connection rod 234 via a screw. A second end of the connection rod is pivotably secured to the support of the lower jaw. More particularly, as shown in FIG. 22, the lower jaw piece is secured to the support about a jaw axle 236, which allows the jaw to move up and down. The connection rod includes a hook 238 to which a compression spring 226 is secured, for instance by twisting a top portion of the spring around the hook. The compression spring pushes upward on the hook, thereby ensuring that the connection rod and corresponding lower jaw are closed when the lever is at rest. When a user pulls the handle of the lever, the front end of the arm rotates about the fixed rotational axle, which pushes the rear end of the arm upward. When the rear end is pushed upwards, the connection rod is also pushed upwards, and the compression spring extends. This forces the lower piece of the jaw to rotate about its axle thereby opening, i.e., moving downward, as the connection rod pushes the support upward, see FIG. 22. When the lever is released, the compression spring returns to its original shape and pulls the connection rod down and the lever returns to its original resting position.

Furthermore, as shown in FIGS. 20-22. The housing 50 advantageously includes a lever switch 241 that is secured within the housing in a specific location and distance adjacent to the hook 238 of the connection rod 234. As shown in FIGS. 20 and 21, when the lever is at rest, the lever switch is not triggered. As shown in FIG. 22, when the lever is pulled, the hook on the connection rod is pushed upward into the lever switch, thereby triggering it. The lever switch is electrically connected to the main microcontroller unit 237 which is secured within the housing. As shown in FIGS. 19-22, the microcontroller unit is secured within the upper jaw piece 210. The microcontroller unit controls all functions of the bubble producing toy 200, including sounds, light effects, IR signal transmitting and receiving and stored FC audio. Secured in the upper jaw piece is a speaker 244, which is electrically connected to the microcontroller unit and the lever switch. When the lever switch is closed via the pulling of the lever, prestored sound audio, which is stored in an FX audio player connected to the microcontroller unit is played through the speaker, such as a chomping sound. Further secured within the housing and electrically connected to the microcontroller unit is a wireless transmitter 246 and receiver 248, such as Infrared transmitter and receiver. Accordingly, one mode of operation of the second embodiment includes playing a sound from the speaker and shooting bubbles from the bubble emitter 86 when an IR signal is received. Further, there are LEDS 250, 252, which are advantageously secured above the speaker and directed out from the face within the eyes of the housing to blink in a sequential order to make the unicorn appear to be blinking.

Figure 16:
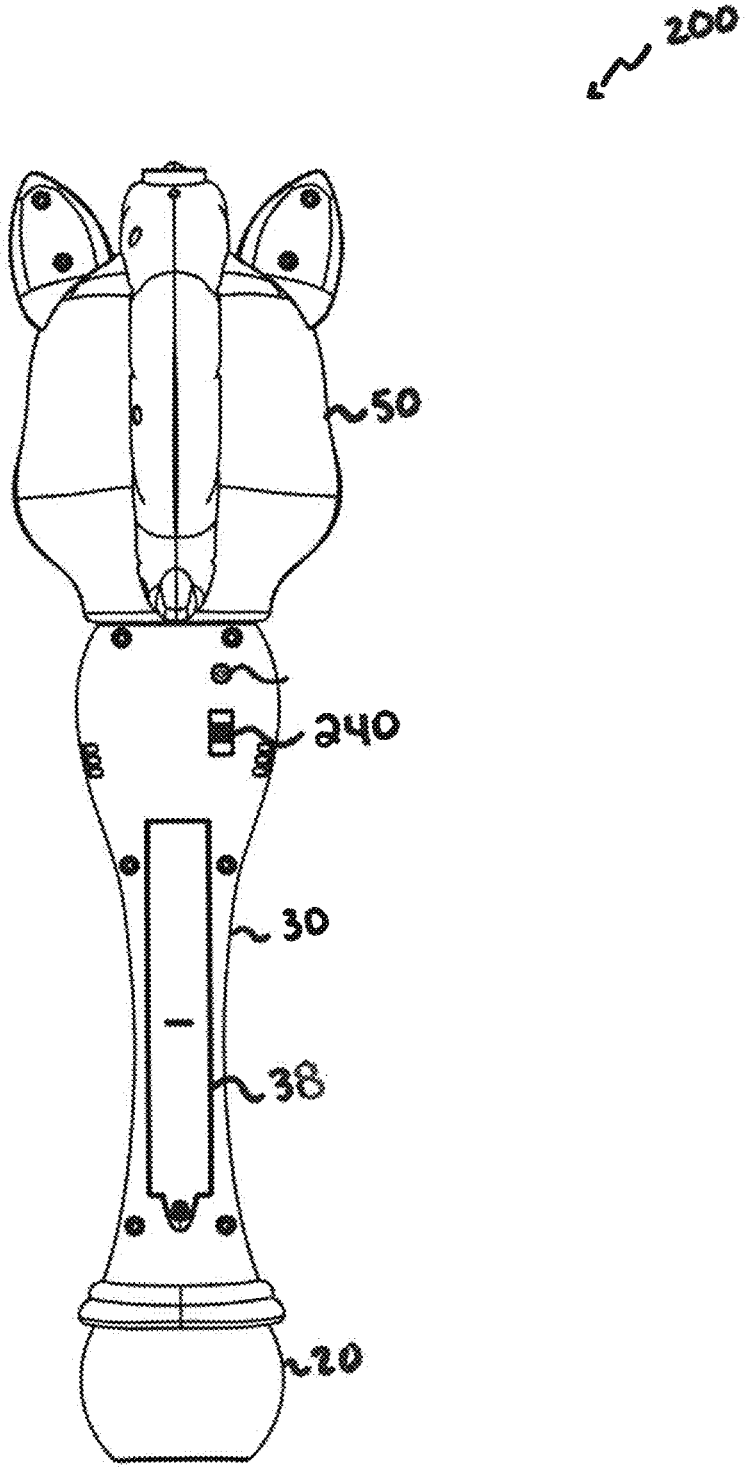
FIG. 16 is a back view of the second embodiment of the bubble producing toy shown in FIG. 15.
Figure 17:
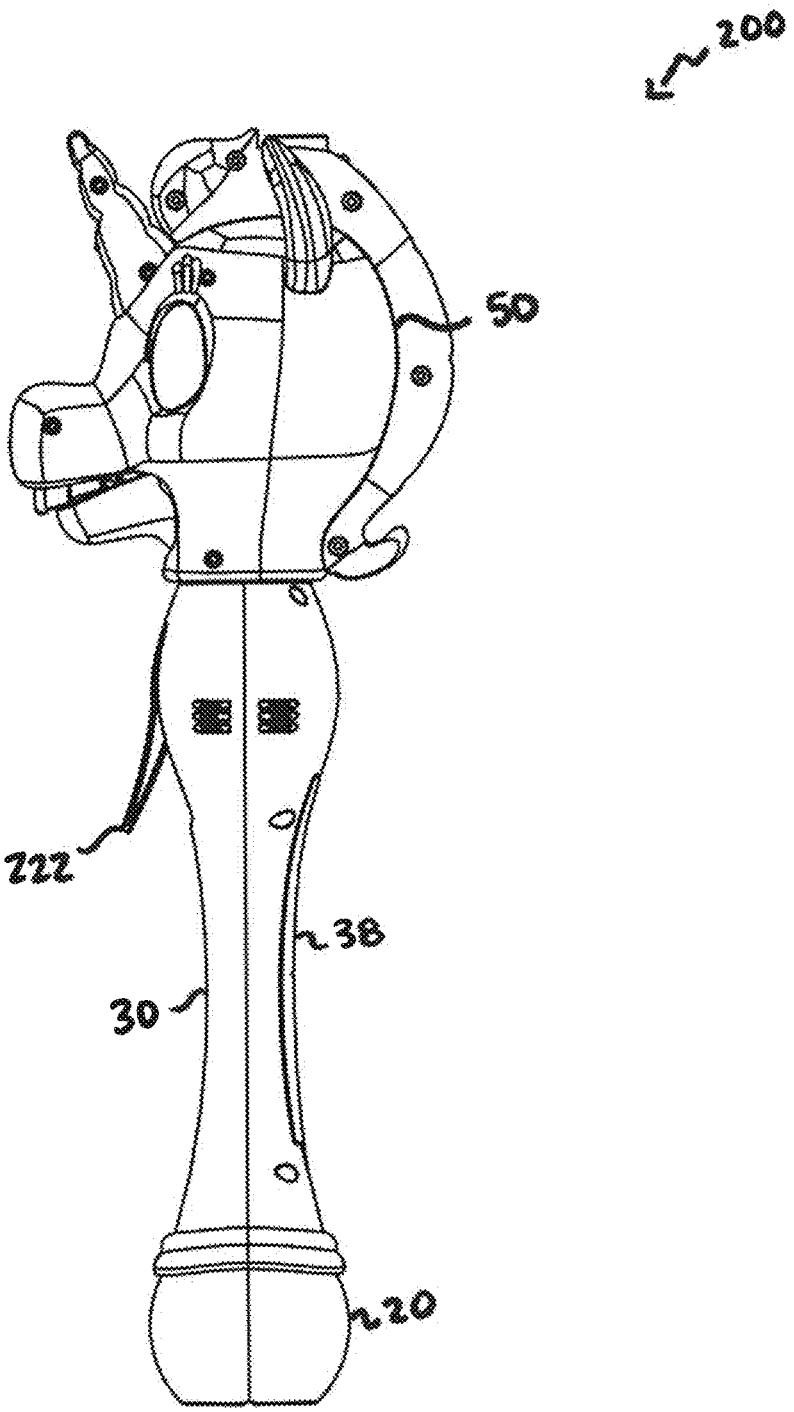
FIG. 17 is a side view of the second embodiment of the bubble producing toy shown in FIG. 15.
Figure 18:
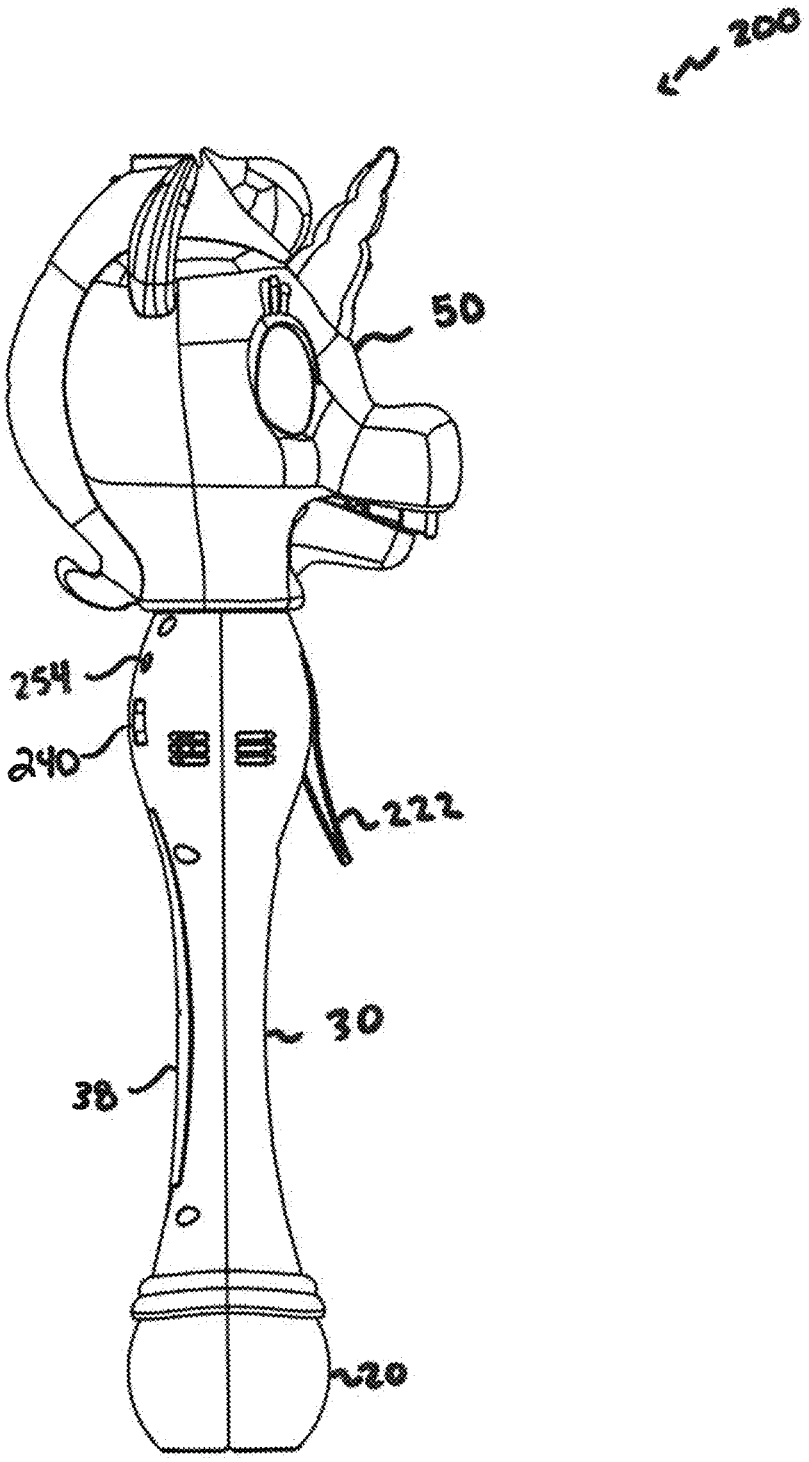
FIG. 18 is another side view of the second embodiment of the bubble producing toy shown in FIG. 15.

Further, as shown in FIGS. 16 and 19, in addition to the lever 220, the user activates the toy 200 via a push button 254 or a slide switch 240. The slide switch and the push button activate different modes of the bubble toy. For example, when a user presses the button, it triggers a song that is stored in the audio IC and automatically plays this sound through the speaker 244. When a user slides the switch up, which can be independent or simultaneously operating with the features of the push button, the toy produces bubbles and the various LEDS located within the toy illuminate and a song plays automatically. In this mode, a song is played when a user pulls the lever 220. If a user slides the switch down, the LEDs automatically turn on and rotate through a preprogrammed sequence and pulling the lever plays a sound while also transmitting an IR signal to activate a feature within a nearby toy or fixture. Furthermore, when the toy receives an IR signal, bubbles shoot from the toy, the LEDs are activated, and a sound is played. These various modes are not to be construed as limiting as the sound, light, bubble production, and transmitting and receiving IR signals for activation are all capable of being programmed and operational together via the programming of the microcontroller unit.

Further, advantageously, in the second embodiment of the toy 200, the solution channel 26 and the recirculation channel 29 are positioned so that the chomping mechanism within the housing 50 to does not interfere with the bubble producing feature of the toy. As shown in FIG. 22, the solution channel is secured on one side of the lever, and the recirculation channel is secured on the other side. Therefore, the toy is fully operational when producing bubbles and chomping simultaneously. The unique location of the solution channels avoids any interference from the moving portions within the shaft and the housing, which would interfere with bubble production. Further, due to the use of the converter 100 the recirculation channel 29, bubble solution does not leak from the solution channel into the electronics secured within the housing, leading to a superior toy.

In another embodiment the bubble producing features of the toy within the housing are rotated horizontally, so that the bubbles are emitted from the mouth of the unicorn. Accordingly, a user chomps the bubbles when they are emitted from the mouth.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

The invention claimed is:

1. A chomping bubble producing toy comprising:

a shaft having a first and second end;

a bubble producing solution reservoir securable to the first end of the shaft;

a housing secured to the second end of the shaft, wherein the housing includes an upper jaw and a moveable lower jaw piece, wherein the lower jaw piece comprises a support that extends into the housing;

a lever comprising a lever handle and an arm with a first and second end, wherein the arm is secured within the second end of the shaft;

a connection rod comprising a first and second end, wherein the first end of the rod is pivotably secured to the second end of the arm and the second end of the rod is pivotably secured to the support of the lower jaw piece;

a bubble producing engine secured within the housing; and a bubble producing solution channel comprising a tubular structure, wherein the channel extends from the solution reservoir to a bubble discharge nozzle secured to the bubble engine.

2. The chomping bubble producing toy of claim 1, further comprising a transmitter and a receiver secured within the housing.

3. The chomping bubble producing toy of claim 1, further comprising a speaker secured within the housing.

4. The chomping bubble producing toy of claim 1, wherein the connection rod further comprises a hook.

5. The chomping bubble producing toy of claim 4, further comprising a compression spring secured to the hook.

6. The chomping bubble producing toy of claim 1, wherein pulling of the lever handle separates the lower jaw piece from the upper jaw.

7. The chomping bubble producing toy of claim 1, further comprising a recirculation channel comprising a tubular structure, wherein the recirculation channel extends from the bubble discharge nozzle to the bubble producing solution reservoir.

8. The chomping bubble producing toy of claim 1, further comprising LEDs secured within the housing.

9. A chomping bubble producing toy comprising:

a shaft having a first and second end;

a bubble producing solution reservoir securable to the first end of the shaft;

a housing secured to the second end of the shaft, wherein the housing includes an upper jaw and a moveable lower jaw piece, wherein the lower jaw piece comprises a support that extends into the housing;

a lever comprising a lever handle and an arm with a first and second end, wherein the arm is secured within the second end of the shaft;

a connection rod comprising a first and second end and a hook therebetween, wherein the first end of the rod is pivotably secured to the second end of the arm and the second end of the rod is pivotably secured to the support of the lower jaw piece;

a lever switch secured within the housing;

a bubble producing engine secured within the housing; and a bubble producing solution channel comprising a tubular structure, wherein the channel extends from the solution reservoir to a bubble discharge nozzle secured to the bubble engine.

10. The chomping bubble producing toy of claim 9, wherein the lever switch is secured within the housing at a contactable distance from the hook.

11. The chomping bubble producing toy of claim 10, further comprising a speaker, wherein contact of the hook with the lever switch automatically plays sound from the speaker.

12. The chomping bubble producing toy of claim 9, further comprising a compression spring secured to the hook.

13. The chomping bubble producing toy of claim 9, further comprising LEDs secured within the housing.

14. The chomping bubble producing toy of claim 9, further comprising a recirculation channel comprising a tubular structure, wherein the recirculation channel extends from the bubble discharge nozzle to the bubble producing solution reservoir.

15. A chomping bubble producing toy comprising:

a shaft having a first and second end;

a bubble producing solution reservoir securable to the first end of the shaft;

a housing secured to the second end of the shaft, wherein the housing includes an upper jaw and a moveable lower jaw piece, wherein the lower jaw piece comprises a support that extends into the housing;

a speaker secured within the housing;

a transmitter secured within the housing;

a lever comprising a lever handle and an arm with a first and second end, wherein the arm is secured within the second end of the shaft;

a connection rod comprising a first and second end and a hook therebetween, wherein the first end of the rod is pivotably secured to the second end of the arm and the second end of the rod is pivotably secured to the support of the lower jaw piece;

a lever switch secured within the housing at a contactable distance from the hook;

a bubble producing engine secured within the housing; and a bubble producing solution channel comprising a tubular structure, wherein the channel extends from the solution reservoir to a bubble discharge nozzle secured to the bubble engine.

16. The chomping bubble producing toy of claim 15, wherein the lever switch contacts the hook when the lever handle is pulled.

17. The chomping bubble producing toy of claim 16, wherein contact of the hook with the lever switch automatically plays sound from the speaker.

18. The chomping bubble producing toy of claim 17, wherein contact of the hook with the lever switch further automatically transmits a signal from the transmitter.

19. The chomping bubble producing toy of claim 15, further comprising LEDs secured within the housing.

20. The chomping bubble producing toy of claim 15, further comprising a compression spring secured to the hook.

* * * * *